US005880064A

United States Patent [19]

Kagota et al.

[11] Patent Number: 5,880,064

[45] Date of Patent: Mar. 9, 1999

[54] CARBONLESS PRESSURE-SENSITIVE COPYING PAPER

[75] Inventors: Nobuhiro Kagota; Hironori Wada, both of Tokyo, Japan

[73] Assignee: Mitsubishi Paper Mills Ltd., Tokyo, Japan

[21] Appl. No.: 839,183

[22] Filed: Apr. 23, 1997

[30] Foreign Application Priority Data

| | | | |
|---|---|---|---|
| Apr. 26, 1996 | [JP] | Japan | 8-107173 |
| Nov. 29, 1996 | [JP] | Japan | 8-319474 |
| Feb. 21, 1997 | [JP] | Japan | 9-037247 |

[51] Int. Cl.[6] ..... B41M 5/165

[52] U.S. Cl. ..... 50/213; 503/215; 503/220; 503/221; 503/225

[58] Field of Search ..... 427/150–152; 503/213, 215, 220, 221, 225

[56] References Cited

FOREIGN PATENT DOCUMENTS 8-169178 7/1996 Japan ..... 503/213

*Primary Examiner*—Bruce H. Hess
*Attorney, Agent, or Firm*—Nixon & Vanderhye P.C.

[57] ABSTRACT

A carbonless pressure-sensitive copying paper which uses a solvent free of an unpleasant odor and friendly to environments and is excellent in color formability and image keeping properties, the copying paper having a layer containing microcapsules enclosing a color former dissolved in a solvent, the solvent being a middle-length-chain triglyceride (MCT), the color former being an indolylazaphthalide compound or a fluoran compound having a trifluoromethylanilino group, the color former further containing a color former different in kind, the solvent further containing a specific fatty acid ester solvent in combination with the MCT, and the color developer being an inorganic color developer, preferably a simi-synthetic solid acid.

20 Claims, No Drawings

CARBONLESS PRESSURE-SENSITIVE COPYING PAPER

FIELD OF THE INVENTION

The present invention relates to a carbonless pressure-sensitive copying paper making use of a color-forming reaction between an electron-donating color former and an electron-accepting color developer. Further, it relates to a carbonless pressure-sensitive copying paper having high safety in view of environments.

PRIOR ART

Basically, a carbonless pressure-sensitive copying paper is obtained by stacking a top sheet and a bottom sheet one on the other, the top sheet being prepared by dissolving an electron-donating color former (to be referred to as "color former" hereinafter) in a solvent having a high boiling point to enclose it in microcapsules and coating a reverse surface of a substrate sheet with the resultant coating solution and the bottom sheet being prepared by forming a coating containing an electron-accepting color developer (to be referred to as "color developer" hereinafter) on a top surface of a substrate sheet, and when a printing is conducted on the carbonless pressure-sensitive copying paper, the color former flows out of the microcapsules of the top sheet and transfers to the bottom sheet to color the coating of the color developer, whereby a reproduced image is instantaneously obtained when the printing is conducted under pressure.

When a plurality of copies are required, an intermediate sheet is prepared by forming a layer containing the color developer on the top surface of a substrate sheet and forming a layer containing the color former enclosed in microcapsules on the reverse surface of a substrate sheet, and the intermediate sheet or the so-prepared intermediate sheets in the number as required are inserted between the top sheet and the bottom sheet. As embodiments of the carbonless pressure-sensitive copying paper, there are also known a self-color-forming pressure-sensitive paper in which a layer containing a color former enclosed in micricapsules and a layer containing a color developer are laminated on one surface of a substrate sheet or formed thereon as a mixed layer, and a plain paper transfer pressure-sensitive copying paper obtained by forming a coating containing microcapsules enclosing a color former, microcapsules enclosing a color developer and a wax on a reverse surface of a substrate sheet.

For producing microcapsules enclosing a color former, a variety of methods are known. Typical examples of the methods include the following various methods.

- A coacervation method using a poly ion complex of gelatin-gum arabic.
- An interfacial polymerization method in which an insoluble coating is formed in an interface between a hydrophilic liquid as a dispersion medium and a hydrophobic liquid which is to be enclosed.
- An in situ polymerization method in which an initial polycondensation product such as a melamine-formaldehyde resin or a urea-formaldehyde resin is added from the side of a hydrophilic liquid as a dispersion medium, and then formed into a resin to form capsules.

Of capsules obtained by the above methods, synthetic resin capsules are frequently used for reasons that raw materials are stably supplied and inexpensive, that a dispersion having a high concentration of microcapsules is obtained and that the production step is simple.

As a color former enclosed in microcapsules, there are known a triphenylmethane phthalide compound, a fluoran compound, a phenothiazine compound, an indolyl phthalide compound, a leuco Auramine compound, a Rhodamine lactam compound, a triphenylmethane compound and a spiropyran compound. About 80% of carbonless pressure-sensitive copying paper products are for forming blue colors, and Crystal Violet Lactone (to be abbreviated as "CVL" hereinafter) included in the triphenylmethane phthalide compound is generally widely used since the color formation is sharp, the printing density is easily increased and it is inexpensive.

The solvent for dissolving the color former as a main solvent is selected from alkylated biphenyl, alkylated terphenyl, chlorinated paraffin, alkylated naphthalene, a diaryl alkane or a phthalate ester. Since, however, most of these has an unpleasant odor and since some of them have chemical structures unfriendly to environments, it is therefore desirable to use a compound which is safe and friendly to environments.

In view of the above points, animal and plant oils may be desirable raw materials, while these are insufficiently capable of dissolving the above color formers, and in particular, their capability of dissolving CVL is low. Further, the animal and plant oils have a problem that they show an increased viscosity or are solidified at room temperature or low temperatures, and these oils therefore have not been so far used.

When CVL is used, some solvent cause the following color formation inhibitions or problems. It is difficult to obtain an image having a high color formation density, the image density of a formed color gradually decreases (in sensitivity), and an image of a formed color is discolored when exposed to sunlight or water.

Black color formers are also generally used in copying slips, etc. However, the black color formers have low color formability as compared with CVL used as a main dye in blue color formers, and it is required to coat a by far larger amount thereof on a substrate sheet than that of the blue color former. Generally, a black color former dissolved in a high concentration is enclosed in micrcapsules so that the total amount of a coating thereof on a substrate sheet is nearly equivalent to that of a blue color former on a top sheet, whereby an extreme increase in the amount of the coating thereof is avoided.

However, when a color former is dissolved in a high concentration and allowed to cool, the color former is liable to precipitate in a solution. In particular, the problem is that when a solvent having a low solubility, such as an animal or plant oil, is used, a crystal is extremely precipitated, so that no good microcapsules can be produced.

Further, the black color former is mostly selected from compounds having a fluoran structure. The problem is that a formed color turns reddish when exposed to light or oxidizing gas and that the above tendency is found to a greater extent when animal and plant oils are used.

SUMMARY OF THE INVENTION

It is therefore an object of the present invention to provide a carbonless pressure-sensitive copying paper excellent in color formability and the property of image keeping, by using a solvent free of unpleasant odors and friendly to environments.

According to the present invention, there is provided a carbonless pressure-sensitive copying paper for forming a color-formed image on the basis of a color-forming reaction between an electron-donating color former and an electron-accepting color developer, the carbonless pressure-sensitive copying paper comprising a substrate sheet coated with a layer containing microcapsules each of which encloses a solution containing electron-donating color former dissolved in a middle-length-chain triglyceride as a solvent.

DETAILED DESCRIPTION OF THE INVENTION

The present inventors have made diligent studies in view of the above problems and have developed a carbonless pressure-sensitive copying paper having the following characteristics, which can overcome the above problems.

That is, when a middle-length-chain fatty acid triglyceride (to be abbreviated as "MCT" hereinafter) is used for dissolving an electron-donating color former to be enclosed in microcapsules for a carbonless pressure-sensitive paper, there can be obtained a carbonless pressure-sensitive copying paper which is free of unpleasant odor, friendly to environments and excellent in the capability of color formation and image keeping.

In particular, MCT used in the present invention is preferably a compound which has a viscosity, measured at 25° C., of 10 to 40 centipoise, which contains no unsaturated bond, which is in a liquid state at 25° C., and which has a composition formed from a fatty acid having 6 to 10 carbon atoms and glycerin.

Further, when a fatty acid ester solvent is used in combination with MCT as a solvent for dissolving a color former, there can be obtained a carbonless pressure-sensitive copying paper which gives an image of excellent color formation.

As a fatty acid ester solvent, it is preferred to use a fatty acid ester solvent having 14 to 20 carbon atoms which is synthesized from a lower alcohol having 1 to 4 carbon atoms and a fatty acid having 12 to 16 carbon atoms. Preferably, the mixing ratio of MCT and the fatty acid solvent as a solvent is as follows. The amount of MCT is preferably 20 to 90% by weight, and the amount of the fatty acid ester solvent is 10 to 80% by weight. In particular, when a bottom sheet using an organic color developer as a color developer is used in combination with a top sheet coated with a color former using a solvent of MCT alone, a color-formed image of printing or writing tends to bleed to some extent, and it is therefore preferred to use MCT and the fatty acid ester solvent in combination.

In the present invention, the carbonless pressure-sensitive copying paper for forming a blue color uses an indolylazaphthalide compound of the following formula (1) as a color former, and it is preferred to use the indolylazaphthalide compound of the formula (1) as a main color former.

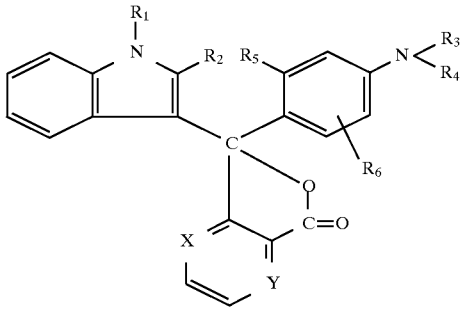

(1)

wherein $R_1$ is a substituted or non-substituted alkyl group having 1 to 12 carbon atoms, $R_2$ is a hydrogen atom or an alkyl group having 1 to 8 carbon atoms, each of $R_3$ and $R_4$ is independently a hydrogen atom, a substituted or non-substituted alkyl group having 1 to 12 carbon atoms, a cycloalkyl group, a benzyl group or a phenyl group, each of $R_5$ and $R_6$ is a hydrogen atom, a halogen atom, an alkyl group having 1 to 8 carbon atoms or an alkoxy group having 1 to 12 carbon atoms, one of X and Y is —N═ and the other of X and Y is —CH═.

As a color former, Crystal Violet Lactone may be used in combination with the indolylazaphthalide compound of the formula (1), or Crystal Violet Lactone and a fluoran compound of the following formula (2) may be used.

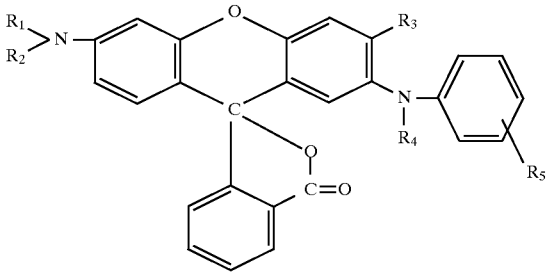

(2)

wherein each of $R_1$ and $R_2$ is independently a lower alkyl group, $R_3$ is a hydrogen atom, a lower alkyl group or a halogen atom, $R_4$ is a hydrogen atom or a lower alkyl group, and $R_5$ is a hydrogen atom or an optionally substituted lower alkyl group.

As an electron-donating color former, further, it is preferred to use 40 to 90% by weight of the indolylazaphthalide compound of the formula (1), 10 to 40% by weight of Crystal Violet Lactone and 0 to 20% by weight of the fluoran compound of the formula (2).

In the present invention, further, the carbonless pressure-sensitive copying paper for forming a black color uses a fluoran compound of the following formula (3) as a color former. This color former has a characteristic feature in that it has a trifluoromethylanilino group, and it is preferred to use the fluoran compound of the formula (3) as a main color former.

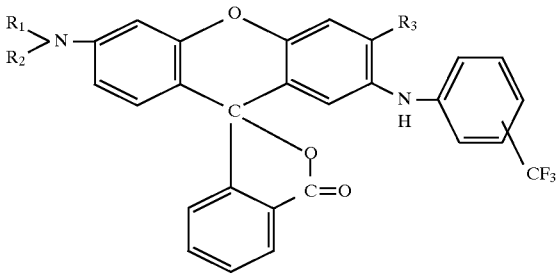

(3)

wherein each of $R_1$ and $R_2$ is independently a lower alkyl group or a cycloalkyl group and $R_3$ is hydrogen or a lower alkyl group.

As a color former, a fluoran compound of the following formula (4) may be used in combination with the fluoran compound of the formula (3), and the fluoran compound of the formula (4) and Crystal Violet Lactone may be used.

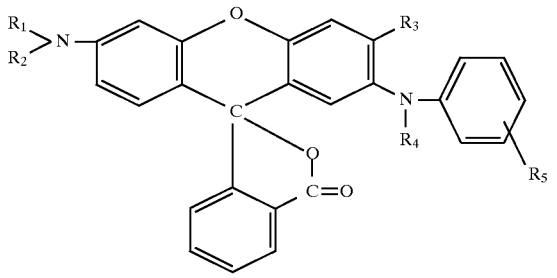

(4)

wherein each of $R_1$ and $R_2$ is independently a lower alkyl group, $R_3$ is a hydrogen atom, a lower alkyl group or a halogen atom, $R_4$ is a hydrogen atom or a lower alkyl group, and $R_5$ is a hydrogen atom or a lower alkyl group.

As an electron-donating color former, it is preferred to use 30 to 80% by weight of the fluoran compound having a trifluoromethylanilino group, represented by the formula (3), 10 to 50% by weight of the fluoran compound of the formula (4), the total amount of the compound of the formula (3) and the compound of the formula (4) being 60 to 100% by weight, and 0 to 40% by weight of Crystal Violet Lactone.

As a color former, the present invention uses a compound having sufficient solubility in the solvent. Preferably, at least 1 g of the compound is soluble in 100 g of the solvent, and particularly preferably, at least 5 g of the compound is soluble in 100 g of the solvent. When the concentration of a color former used as microcapsules is extremely increased, the efficiency of transfer thereof to a bottom sheet is not increased. As a result, in few cases, 20 g or more of the color former is dissolved in the solvent, and it is not necessary to select a color former having a solubility of more than 20 g per 100 g of the solvent. It is therefore sufficient to use a color former having a solubility of 1 to 20 g per 100 g of the solvent.

When one color former has an insufficient solubility, a combination of the color former with other color former(s) may cause stability in some cases after dissolved, and the present invention includes the use of such a combination.

An organic color developer may be used as a color developer contained in a color developer layer used in combination with a layer containing microcapsules containing the above color former and solvent. However, it is preferred to use an inorganic color developer formed from clay minerals as a raw material, and it is particularly preferred to use a semi-synthetic solid acid obtained by treating clay minerals with an acid, then mixing and neutralizing the acid-treated clay minerals with at least one of an aluminum compound and a magnesium compound in an aqueous medium to introduce at least one component of magnesium and aluminum into the acid-treated clay minerals and drying the acid-treated clay minerals.

The middle-length-chain fatty acid triglyceride and the fatty acid ester compound used as a solvent in microcapsules in the present invention cause less odor and causes no odor under heat. They are therefore suitable for use in a carbonless pressure-sensitive copying sheet for NIP used in printing with a non-impact printer according to an electrophotographic recording method in which a copying sheet is brought into contact with a heating roll for fixing a powder toner.

Preferred embodiments of the carbonless pressure-sensitive copying paper of the present invention are as follows.

(a) A carbonless pressure-sensitive copying paper including a color former sheet obtained by forming a layer containing microcapsules enclosing the electron-donating color former dissolved in the solvent on a substrate sheet, and a color developer sheet obtained by forming a layer containing an inorganic color developer formed from clay minerals as an electron-accepting color developer on other substrate.

(b) A carbonless pressure-sensitive copying paper obtained by forming a layer containing microcapsules enclosing the electron-donating color former dissolved in the solvent on one surface of a substrate sheet and forming a layer containing an electron-accepting color developer on the same surface or the other surface of the substrate sheet, the color developer being an inorganic color developer formed from clay minerals.

The carbonless pressure-sensitive copying paper of the present invention will be explained further in detail hereinafter.

The middle-length-chain fatty acid triglyceride (MCT) used in the present invention generally refers to a liquid oil obtained by esterifying high-purity mixed fatty acids obtained by hydrolyzing natural oil and fat such as coconut oil and glycerin. JP-A-6-183139, JP-A-6-340169 and JP-A-7-81217 disclose the use of a plant oil such as soybean oil, salad oil, cotton seed oil, rape oil, olive oil or coconut oil as an oil contained in microcapsules. However, these natural plant oils have defects that some of them undergo oxidation deterioration caused by intramolecular unsaturated bonds or are in a solid state, and that they have a viscosity of 40 centipoise or more at 25° C. For example, they are not sufficient for use in a carbonless pressure-sensitive copying paper in view of the property of transfer of a substance enclosed in microcapsules to a bottom sheet. On the other hand, MCT is a liquid oil containing no unsaturated bond, has excellent fluidity and capability of dissolving a dye, has no unpleasant odors and has such high safety that it can be used in the fields of foods, cosmetics and medicines.

General animal and plant oils have a composition containing a mixture of long-chain fatty acid triglycerides, and main fatty acids are saturated fatty acids such as palmitic acid (16 carbon atoms) and stearic acid (18 carbon atoms) and unsaturated fatty acids such as oleic acid (18 carbon atoms) The fatty acid used for forming MCT used in the present invention is a middle-length-chain fatty acid having 6 to 10 carbon atoms, and it mainly includes caprylic acid (8 carbon atoms) and capric acid (10 carbon atoms), and these are used alone or in combination. The solvent used in the present invention may partially contain a triglyceride formed from a lower fatty acid having 4 carbon atoms or from a fatty acid having 12 or 14 carbon atoms, while the solvent is substantially composed of triglyceride(s) formed from middle-length-chain fatty acid(s) having 6 to 10 carbon atoms. One or a mixture of these triglycerides has a low surface tension and a low viscosity as compared with general animal and plant oils, and has excellent properties in the dissolving capability, stability against oxidation and infiltration. It is considered that these features make the above triglyceride exhibit capabilities equivalent to, or higher than, those of conventional aromatic solvents, as a solvent for a carbonless pressure-sensitive copying paper.

In the present invention, further, a fatty acid ester solvent may be used in combination with MCT. The fatty acid ester solvent causes less unpleasant odors and is environmentally safe as compared with aromatic solvents such as diarylethane, alkylbiphenyl, alkylterphenyl, alkylnaphthalene, triaryl methane, diphenylalkane, hydroanthracene, hydrophenanthrene and dibenzyltoluene, which are known as solvents for conventional carbonless pressure-sensitive copying paper.

Since, however, the fatty acid ester solvent has a little lower capability of dissolving the color former than MCT, it is undesirable to use it alone. It is therefore preferred to use 20 to 90% by weight of MCT and 10 to 80% by weight of the fatty acid ester solvent in combination. The amount of the fatty acid ester solvent is particularly preferably in the range of from 10 to 40% by weight.

The fatty acid ester solvent used in the present invention is preferably a fatty acid ester solvent which has 14 to 20 carbon atoms and is synthesized from a lower alcohol having 1 to 4 carbon atoms and a fatty acid having 12 to 16 carbon atoms. Examples of the fatty acid ester solvent include ethyl laurate, isopropyl laurate, butyl laurate, methyl myristate, ethyl myristate, isopropyl myristate, butyl myristate, methyl palmitate, ethyl palmitate, isopropyl palmitate and butyl palmitate.

Most of fatty acid ester solvents having more than 20 carbon atoms are in a solid state at room temperature, and cause a difficulty in producing microcapsules in some cases. Further, when the total number of carbon atoms of the fatty acid ester solvent is less than 14, the solvent has a flash point of 100° C. or lower, which increase the risk of causing fire. It is therefore industrially improper to use such a solvent. Further, when a fatty acid ester solvent prepared from an alcohol having a large number of carbon atoms as a raw material is used, an image formed by color formation on a color developer layer tends to bleed, and it is therefore preferred to use a fatty acid ester solvent prepared from a lower alcohol as a raw material.

The solvent for the color former may contain those which have been used for a carbonless pressure-sensitive copying paper, so long as the properties of the carbonless pressure-sensitive copying paper and the safety in view of environments are not impaired. Specific examples thereof include:

(a) mineral oils such as kerosine, paraffin and naphthene, (b) plant oils such as cotton seed oil, soybean oil, corn oil and coconut oil, (c) alcohols such as oleyl alcohol, tridecyl alcohol, benzyl alcohol, 1-phenylethyl alcohol and glycerin, and (d) esters such as dimethyl phthalate, diethyl phthalate, di-n-butyl phthalate, dioctyl phthalate, diethyl adipate, propyl adipate, di-n-butyl adipate and dioctyl adipate.

The indolylazaphthalide compound used as a color former in the present invention is a compound having the above formula (1). When $R_1$ in the formula is an alkyl group, a compound of the formula (1) in which the alkyl group has a larger number of carbon atoms has higher solubility in the solvent, and the number of carbon atoms is preferably 6 to 12.

Although not specially limited, specific examples of the above compound include 3-(4-diethylamino-2-ethoxyphenyl)-3-(1-ethyl-2-methylindol-3-yl)-4- or -7-azaphthalide, 3-(4-dibutylamino-2-ethoxyphenyl)-3-(1-ethyl-2-methylindol-3-yl)-4- or -7-azaphthalide, 3-(4-diethylamino-2-ethoxyphenyl)-3-(1-ethyl-2-phenylindol-3-yl)-4- or -7-azaphthalide, 3-(4-diethylamino-2-ethoxyphenyl)-3-(1-isoamyl-2-methylindol-3-yl)-4- or -7-azaphthalide, 3-(4-diethylamino-2-ethoxyphenyl)-3-(1-octyl-2-methylindol-3-yl)-4- or -7-azaphthalide, 3-(4-diethylamino-2-ethoxyphenyl)-3-(1-octyl-2-methylindol-3-yl)-4- or -7-azaphthalide, 3-(4-diethylamino-2-methylphenyl)-3-(1-octyl-2-methylindol-3-yl)-4- or -7-azaphthalide, 3-(4-dibutylamino-2-ethoxyphenyl)-3-(1-octyl-2-methylindol-3-yl)-4- or -7-azaphthalide, 3-(4-N-cyclohexyl-N-ethylamino-2-ethoxyphenyl)-3-(1-octyl-2-methylindol-3-yl)-4- or -7-azaphthalide, 3-(4-N-ethyl-N-isoamylamino-2-isoamyloxyphenyl)-3-(1-octyl-2-phenylindol-3-yl)-4- or -7-azaphthalide, 3-(4-diethylamino-2-ethoxyphenyl)-3-(1-hexyl-2-methylindol-3-yl)-4- or -7-azaphthalide, and 3-(4-diethylamino-2-ethoxyphenyl)-3-(1-octyl-2-phenylindol-3-yl)-4- or -7-azaphthalide.

The above indolylazaphthalide compounds themselves have relatively good stability in MCT solution, while a mixture thereof with other kind of a color former shows an increased stability in solution, and a mixture thereof with other two or more kinds of color formers shows a further increased stability in solution. However, the kinds and the mixing ratio of the color formers are limited in view of the color formability for blue color formation, the hue of a formed color, the discoloration of a color-formed image caused by light and oxidizing gas and a change in hue.

The present inventors have made studies in various ways, and have found that it is preferred to use, as an electron-donating color former, 40 to 90% by weight of the indolylazaphthalide compound of the formula (1), 10 to 40% by weight of Crystal Violet Lactone and 0 to 20% by weight of the fluoran compound of the formula (2).

Examples of the fluoran compound of the formula (2) include 3-dimethylamino-6-methyl-7-anilinofluoran, 3-diethylamino-6-methyl-7-anilinofluoran, 3-dibutylamino-6-methyl-7-anilinofluoran, 3-N-methyl-N-isopropylamino-6-methyl-7-anilinofluoran, 3-N-ethyl-N-isobutylamino-6-methyl-7-anilinofluoran, 3-N-methyl-N-cyclohexylamino-6-methyl-7-anilinofluoran, 3-N-ethyl-N-isoamylamino-6-methyl-7-anilinofluoran, 3-(N-ethyl-N-p-tolyl)amino-6-methyl-7-anilinofluoran, 3-(N-ethyl-N-p-tolyl)amino-7-N-methyl-N-anilinofluoran, 3-diethylamino-7-(o-chlorophenylamino)fluoran, 3-dibutylamino-7-(o-chlorophenylamino)fluoran, 3-diethylamino-6-chloro-7-anilinofluoran, and 3-diethylamino-7-m-trifluoromethylaminofluoran, although the fluoran compound of the formula (2) shall not be limited to these.

In addition to CVL and the fluoran compound of the formula (2), the color former that is used in combination with the indolylazaphthalide compound may be selected from those compounds known as color formers for a carbonless pressure-sensitive copying paper, such as a triphenylmethane phthalide compound, a fluoran compound, a phenothiazine compound, an indolylphthalide compound, a leuco Auramine compound, a spiropyran compound, a rhodamine lactam compound, a triphenylmethane compound and an azaphthalide compound, so long as these do not impar the properties of the carbonless pressure-sensitive copying paper and the environmental safety.

Further, there may be used a color former which generates a color-formed image having an absorption wavelength of 600 to 1,000 nm. The above color former includes various compounds such as a monovinyl compound, a divinyl compound and a fluorene compound as disclosed in JP-A-4-212882.

In the present invention, further, the fluoran compound having a trifluoromethylanilino group, represented by the formula (3), includes 3-dimethylamino-7-(m-trifluoromethylanilino)fluoran, 3-diethylamino-7-(m-trifluoromethylanilino)fluoran, 3-di(n-butyl)amino-7-(m-trifluoromethylanilino)fluoran, 3-(N-ethyl-N-isobutyl) amino-7-(m-trifluoromethylanilino)fluoran, 3-(N-ethyl-N-isoamyl)amino-7-(m-trifluoromethylanilino)fluoran, 3-(N-methyl-N-cyclohexyl)amino-7-(m-trifluoromethylanilino) fluoran, 3-diethylamino-6-methyl-7-(m-trifluoromethylanilino)fluoran, 3-di(n-butyl)amino-6-methyl-7-(m-trifluoromethylanilino)fluoran, 3-diethylamino-7-(o-trifluoromethylanilino)fluoran, 3-(N-ethyl-N-isobutyl) amino-7-(o-trifluoromethylanilino)

fluoran, 3-diethylamino-7-(p-trifluoromethylanilino)fluoran, and 3-(N-ethyl-N-isoamyl)amino-7-(p-trifluoromethylanilino)fluoran.

The above fluoran compounds having a trifluoromethylanilino group have relatively good stability in MCT solution, while a mixture thereof with other kind of a color former shows an increased stability in solution, and a mixture thereof with other two or more kinds of color formers shows a further increased stability in solution. However, the kinds and the mixing ratio of the color formers are limited in view of the color formability for black color formation, the hue of a formed color, the discoloration of a color-formed image caused by light and oxidizing gas and a change in hue.

The present inventors have made various studies for black color formation, and have been able to an excellent carbonless pressure-sensitive copying paper by the use of 30 to 80% by weight of the fluoran compound having a trifluoromethylanilino group, represented by the formula (3), 10 to 50% by weight of the compound of the formula (4), the total amount of the compound of the formula (3) and the compound of the formula (4) being 60 to 100% by weight, and 0 to 40% by weight of CVL.

It is known that the fluoran compound having a trifluoromethylanilino group, represented by the formula (3), gives a color-formed image of which the discoloration relatively does not take place under light and an oxidizing gas. In view of a color formation intensity and a color formation hue, however, it is effective to use the fluoran compound of the formula (4) in combination. When the hue of a color-formed image is extremely altered under light and an oxidizing gas due to the use of the fluoran compound of the formula (4), the alteration can be offset by the use of CVL in combination.

The use of a mixture of the fluoran compound having a trifluoromethylanilino group, represented by the formula (3), with a color former different in kind can exhibit excellent performance over the use of the fluoran compound of the formula (3) alone in view of the color formability and the stability of a solution of color formers in the solvent.

The fluoran compound of the formula (4) includes 3-dimethylamino-6-methyl-7-anilinofluoran, 3-diethylamino-6-methyl-7-anilinofluoran, 3-dibutylamino-6-methyl-7-anilinofluoran, 3-N-methyl-N-isopropylamino-6-methyl-7-anilinofluoran, 3-N-ethyl-N-isobutylamino-6-methyl-7-anilinofluoran, 3-N-methyl-N-cyclohexylamino-6-methyl-7-anilinofluoran, 3-N-ethyl-N-isoamylamino-6-methyl-7-anilinofluoran, 3-(N-ethyl-N-p-tolyl)amino-6-methyl-7-anilinofluoran, 3-(N-ethyl-N-p-tolyl)amino-7-N-methyl-N-anilinofluoran, 3-diethylamino-7-(o-chlorophenylamino)fluoran, 3-dibutylamino-7-(o-chlorophenylamino)fluoran, and 3-diethylamino-6-chloro-7-anilinofluoran, although the fluoran compound of the formula (4) shall not be limited to these.

In addition to the fluoran compound of the formula (4) and CVL, the color former which is used in combination with the fluoran compound having a trifluoromethylanilino group may be selected from compounds known to be used for a carbonless pressure-sensitive copying paper, such as a triphenylmethane-phthalide compound phenothiazine compound, a phenothiazine compound, an indolylphthalide compound, a leuco Auramine compound, a spiropyran compound, a rhodamine lactam compound, a triphenylmethane compound and an azaphthalide compound, so long as these do not impar the properties of the carbonless pressure-sensitive copying paper and the environmental safety.

Further, the above color former which generates a color-formed image having an absorption wavelength of 600 to 1,000 nm may be used.

When the color former is enclosed in microcapsules, an ultraviolet absorbent, a light stabilizer and an anti-oxidant may be dissolved in an oil to be contained in the microcapsules as these are conventionally used. Those substances which are generally used for a general carbonless pressure-sensitive copying paper may be used without any limitation.

The micro-encapsulation method used in the present invention is not specially limited. However, when microcapsules obtained by a coacervation method using gelatin or gum arabic are mixed with a latex, coatings are sometimes broken. It is therefore preferred to employ an interfacial polymerization method, an in situ polymerization method or a micro organism micro-encapsulation method. As an emulsifier for the encapsulation by an in situ polymerization method, a polymer electrolytic substance is preferred. Specific examples thereof include an aqueous solution of a styrene-maleic anhydride copolymer, a styrene-benzyl methacrylate-maleic anhydride copolymer, an α-alkylstyrene-maleic anhydride copolymer, a copolymer of styrene having monoalkyl substituted on the ring thereof and maleic anhydride, a copolymer of styrene having dialkyl substituted on the ring thereof and maleic anhydride, a styrene-maleic anhydride monoalkyl ester copolymer, an ethylene-maleic anhydride copolymer, polystyrenesulfonic acid, polyacrylic acid or an acrylic acid-acrylate ester copolymer, and a mixture of at least two aqueous solutions of these.

The emulsifier used for the encapsulation by an interfacial polymerization method is selected from an aqueous solution of polyvinyl alcohol, carboxymethyl cellulose, hydroxyethyl cellulose, or a processed starch (wheat, potato, corn, etc.) or a mixture of at least two aqueous solutions of these, in addition to those used for the encapsulation by the above in situ polymerization method. Further, a known nonionic, cationic or amphoteric substance having surface activity may be used in combination so long as it does not cause any problem on the above encapsulation step.

The size (average diameter) of microcapsules enclosing the color former, used in the present invention, is preferably in the range of from 1 to 20 μm, particularly preferably in the range of from 2 to 10 μm. The amount of the color former to form a layer differs to some extent depending upon the kind of a selected color former and is not specially limited. In view of the color formability, the above amount of the color former is in the range of from 5 to 1,000 mg/M$^2$, particularly preferably in the range of from 20 to 200 mg/m$^2$.

Generally, a water-based coating liquid is used for forming a layer containing microcapsules. The coating liquid is prepared by adding various aids known in the filed of this art such as a latex binder, a water-soluble binder, a capsule protective agent, a white pigment, a surfactant, an anti-foaming agent, a thickener, an antiseptic, a colorant, etc., to a dispersion of microcapsules enclosing the color former obtained by the above method, as required. The content of the capsules in the coating liquid is generally adjusted to 5 to 80 parts by weight per 100 parts by weight (solid content) of the coating liquid.

Specific examples of the latex binder include a styrene-butadiene copolymer latex, an acrylonitrile-butadiene copolymer latex, a vinyl acetate latex, an acrylic latex, and latices prepared by increasing the viscosities of these with an alkali. Examples of the water-soluble binder include natural, synthetic or semi-synthetic polymers such as gelatin, albumin, casein, starch, α-starch, oxidized starch, etherified starch, esterified starch, sodium alginate, gum arabic, carboxymethyl cellulose, polyvinyl alcohol, polyvinyl pyrrolidone, polyacrylic acid, polyacrylamide, an ethylene-maleic anhydride copolymer, an isobutylene-maleic anhydride copolymer, a styrene-maleic anhydride copolymer, a methyl vinyl ether-maleic anhydride copolymer and methyl cellulose. The above binders may be used alone or in combination. The amount of the binder per 100 parts by dry solid weight of microcapsules is preferably in the range of from 5 to 100 parts by solid weight, particularly preferably 5 to 50 parts by solid weight.

The capsule protective agent used in the present invention preferably selected from known agents such as wheat starch, corn starch, pea starch, various platic pigments and a pulp powder. The size (average diameter) of the capsule protective agent is preferably 1 to 100 $\mu$m, particularly preferably 4 to 30 $\mu$m. When a white pigment is added to the coating liquid containing the microcapsules, the white pigment is selected, for example, from calcium carbonate, aluminum hydroxide, zinc oxide, titanium oxide, kaolin and talc.

The coating liquid is coated with a general coater and dried. The coater is selected from an air knife coater, a blade coater, a rod coater, a bar coater, a roll coater, a size press coater and a curtain coater.

The carbonless pressure-sensitive copying paper having a layer containing a color developer, used in combination with the above carbonless pressure-sensitive copying paper according to the present invention, is obtained by preparing a water-based or non-aqueous coating liquid of the color developer and applying the coating liquid to a substrate sheet. Generally, a water-based coating liquid is used. The coating liquid is prepared by adding known various aids such as a binder and a pigment in addition to the color developer and adding a dispersing agent, a surfactant, an ultraviolet absorbent, a fluorescent brightener, a thickener and an anti-foaming agent as required, and the coating liquid is applied to a substrate sheet with any one of the above coater.

An organic color developer may be used as a color developer in the present invention. However, it is preferred to use an inorganic color developer formed from clay minerals in view of the prevention of bleeding of a color-formed image, and it is particularly preferred to use a semi-synthetic solid acid obtained by treating clay minerals with an acid, then mixing and neutralizing the acid-treated clay minerals with at least one of an aluminum compound and a magnesium compound in an aqueous medium to introduce at least one component of magnesium and aluminum into the acid-treated clay minerals and drying the acid-treated clay minerals. The semi-synthetic solid acid can be produced, for example, by the method disclosed in JP-B-63-15158.

Examples of the electron-accepting organic color developer include a novolak type phenolic resin or a polyvalent metal salt thereof, a salicylic acid derivative or a polyvalent metal salt thereof, and a salicylic acid resin or a polyvalent metal salt thereof, while the color developer shall not be limited to these.

The salicylic acid derivative refers to a compound having at least one aromatic substituent. Specific examples thereof include 3-phenylsalicylic acid, 5-phenylsalicylic acid, 3-benzylsalicylic acid, 5-benzylsalicylic acid, 3-($\alpha$-methylbenzyl) salicylic acid, 5- ($\alpha$-methylbenzyl) salicylic acid, 3-($\alpha$,$\alpha$-dimethylbenzyl)salicylic acid, 5- ($\alpha$,$\alpha$-dimethylbenzyl)salicylic acid, 3,5-diphenylsalicylic acid, 3,5-di ($\alpha$,$\alpha$-methylbenzyl) salicylic acid, 3,5-dibenzylsalicylic acid, 3,5-di($\alpha$,$\alpha$-dimethylbenzyl)salicylic acid, and 3,5-di (4-methylbenzyl) salicylic acid. Further, polyvalent metal salt compounds of these may be also used.

The salicylic acid resin or the polyvalent metal salt thereof may be a product formed from any one of the above compounds. For example, it is a product obtained by subjecting the above salicylic acid derivative and styrene or a styrene derivative such as o-, m- or p-methylstyrene, $\alpha$-methylstyrene or $\beta$-methylstyrene to a Friedel-Crafts reaction in a molar ratio of 1:0.5 to 10 in the presence of a strong acid catalyst to obtain a salicylic acid resin and forming it into a polyvalent metal salt. The polyvalent metal includes Ca, Mg, Al, Zn and Mn, while a Zn salt is the most preferred. The above color developers may be used alone or in combination.

The amount of the color developer coating liquid to be applied to a substrate sheet and the content of the color developer in the color developer coating liquid are not specially limited. Generally, however, in view of color forming performance and economic performance, the application amount of the color developer coating liquid is preferably 2 to 20 g/m$^2$, more preferably 3 to 15 g/m$^2$. The content of the color developer in a color developer layer is preferably 2 to 80% by weight, more preferably 5 to 40% by weight when the color developer is an organic color developer, or 50 to 80% by weight when it is an inorganic color developer.

Examples of the pigment used in combination with the color developer include general inorganic or organic white pigments such as heavy calcium carbonate, light calcium carbonate, calcium sulfate, kaolin, calcined kaolin, talc, aluminum hydroxide, aluminum silicate, magnesium oxide, magnesium carbonate, magnesium sulfate, zinc oxide, activated clay, finely powdered silicic acid, titanium oxide, calcium silicate and a urea-formaldehyde resin.

The carbonless pressure-sensitive copying paper of the present invention can be used as a conventional general copying slip of a book, and it is particularly suitable for use as a copying sheet (slip) on which printing is conducted with an electrophotographic non-impact printer in advance.

The solvent enclosed in microcapsules used in a conventional carbonless pressure-sensitive copying paper has a slight odor at room temperature, and when the carbonless pressure-sensitive copying paper is heated at the time of heat-fixing a toner with an electrophotographic non-impact printer, it tends to generate a fierce odor. MCT or the fatty acid ester solvent used in the present invention is free of an odor at room temperature and generates almost no odor at the time of heat-fixing a toner with an electrophotographic non-impact printer.

The odor, even if it is slight, is keenly perceived and decreases the working performance. The present invention can provide the carbonless pressure-sensitive copying paper which is suitable for keeping a good condition of a working environment with an electrophotographic non-impact printer.

EXAMPLES

The present invention will be explained in detail with reference to Examples and Comparative Examples hereinafter, while the present invention shall not be limited to Examples, and substances and production conditions which can be used shall not be limited to those in Examples. In Examples and Comparative Examples, "part" stands for "part by dry solid weight" unless otherwise specified.

EXAMPLES 1–19 and Comparative Examples 1–7

<Method of preparing microcapsules enclosing color former for forming blue color>

180 Parts of a hydrophobic color former solution prepared by dissolving 6 parts of a color former in 94 parts of a solvent was gradually added to 220 parts of a 5% styrene-maleic anhydride copolymer aqueous solution with stirring, and the mixture was continuously stirred until a COULTER counter(JAPAN SCIENTIFIC INSTRUMENTS COMPANY, Ltd.) showed a 50% volume average diameter of 6 μm, to give an emulsion. Separately, a melamine-formaldehyde initial condensate aqueous solution obtained by dissolving 11 parts of melamine, 21 parts of a 37% formaldehyde aqueous solution and 28 parts of water under heat was added to the emulsion, and the mixture was stirred at a temperature of 70° C. for 2 hours, to give a solution containing microcapsules containing the color former.

Those dyes and solvents which were used for microcapsules enclosing the color former in Examples and Comparative Examples and expressed by abbreviations were as follows. As indolylazaphthalide compounds, a color former A: 3-(4-diethylamino-2-ethoxyphenyl)-3-(1-octyl-2-methylindol-3-yl)-4-azaphthalide, and a color former B: 3-(4-diethylamino-2-ethoxyphenyl)-3-(1-ethyl-2-methylindol-3-yl)-4-azaphthalide were used. As color formers other than the indolylazaphthalide compounds, a color former C: 3,3-bis(p-dimethylaminophenyl)-6-dimethylaminophthalide, and a color former D: 3-N-ethyl-N-isoamylamino-6-methyl-7-anilinofluoran were used. As MCT, a triglyceride obtained from caprylic acid and capric acid (Panasate 810, supplied by Nippon Oil & Fats Co., Ltd.) was used.

<Methods of preparing color former coating liquid and top sheet>

70 Parts of wheat starch and 35 parts of a styrene-butadiene copolymer latex (supplied by Japan Synthetic Rubbers Co., Ltd.) were added to 100 parts of the liquid containing microcapsules enclosing the color former, to prepare a color former coating liquid. The coating liquid was applied to woodfree paper having a basis weight of 50 g/m$^2$ such that the application amount was 5 g/m$^2$, to give a top sheet for carbonless pressure-sensitive copying paper.

Microcapsules enclosing a color former in Examples and Comparative Examples were prepared from combinations of the color former(s) and solvent(s) shown in Tables 1 and 2, and top sheets in Examples 1 to 19 and Comparative Examples 1 to 7 were obtained.

TABLE 1

| | Color former | | Solvent | |
|---|---|---|---|---|
| Ex. or CEx. | Kind | Mixing ratio | Kind | Mixing ratio |
| Ex.1 | A | 100 | MCT | 100 |
| Ex.2 | B | 100 | MCT | 100 |
| Ex.3 | A/C | 70/30 | MCT | 100 |
| Ex.4 | A | 100 | MCT/isopropyl myristate | 10/90 |
| Ex.5 | A | 100 | MCT/n-butyl laurate | 20/80 |
| Ex.6 | A/C | 70/30 | MCT/isopropyl myristate | 50/50 |
| Ex.7 | A/C | 70/30 | MCT/ethyl laurate | 80/20 |
| Ex.8 | A/C | 70/30 | MCT/methyl myristate | 50/50 |
| Ex.9 | A/C | 50/50 | MCT/isobutyl palmitate | 90/10 |
| Ex.10 | A/C | 70/30 | MCT/methyl stearate | 50/50 |
| Ex.11 | A/C | 70/30 | MCT/isopropyl caprate | 50/50 |
| Ex.12 | A/C | 70/30 | MCT/isoamyl myristate | 50/50 |
| Ex.13 | A/C | 70/30 | MCT/2-ethylhexyl myristate | 50/50 |
| Ex.14 | A/C | 90/10 | MCT | 100 |
| Ex.15 | A/C | 60/40 | MCT | 100 |
| Ex.16 | A/C | 50/50 | MCT | 100 |
| Ex.17 | A/C/D | 60/30/10 | MCT | 100 |
| Ex.18 | A/C/D | 40/40/20 | MCT | 100 |
| Ex.19 | A/C/D | 70/0/30 | MCT | 100 |

Ex. = Example, CEx. = Comparative Example

TABLE 2

| | Color former | | Solvent | |
|---|---|---|---|---|
| Ex. or CEx. | Kind | Mixing ratio | Kind | Mixing ratio |
| CEx.1 | C | 100 | MCT | 100 |
| CEx.2 | A | 100 | Coconut oil | 100 |
| CEx.3 | A | 100 | soybean oil | 100 |
| CEx.4 | A | 100 | Phenylxylylethane | 100 |
| CEx.5 | A | 100 | Isopropyl myristate | 100 |
| CEx.6 | C | 100 | Isopropyl myristate | 100 |
| CEx.7 | D | 100 | MCT | 100 |

Ex. = Example, CEx. = Comparative Example

Top sheets obtained in Examples and Comparative Examples and commercially available carbonless pressure-sensitive copying paper bottom sheets (Mitsubishi NCR paper super N40 bottom, supplied by Mitsubishi Paper Mills, Ltd.) using a salicylic acid derivative zinc salt as a color developer were combined, and printing was conducted with a typewriter. Tests were conducted with regard to color formability, abrasive scumming, image bleeding and image light resistance according to the following evaluation methods. Table 3 shows the results. Further, tests were also carried out with stability of the color formers in solution and the odor of the solvents when the microcapsules were produced, and Table 3 also shows the results.

The solvents used in Examples and Comparative Examples had the following viscosities at 25° C. MCT had a viscosity of 25 centipoise, the coconut oil had a viscosity of 45 centipoise, and the soybean oil had a viscosity of 48 centipoise.

<Color formability>

One day after the printing with the typewriter, the color formability was visually evaluated on the basis of five ratings. Greater values show better color formability, and ratings of 3 or more show that the color formability is at a practically usable level.

<Hue of formed color>

One day after the printing with the typewriter, the hue of a formed color was visually determined. The hue of a formed blue color in the category preferred for the blue color formation was taken as excellent.

<Abrasive scumming>

A top sheet obtained in one of Examples or Comparative Examples was placed on the carbonless pressure-sensitive copying paper bottom sheet, and these two sheets were rubbed against each other in a distance of 30 cm under a load of 100 g/cm$^2$. The scumming state was evaluated on the basis of five ratings. Greater values show better prevention of scumming, and ratings of 3 or more show that the prevention of scumming is at a practically usable level.

<Image bleeding>

One day after the printing with the typewriter, the bleeding state of an image was visually evaluated on the basis of five ratings. Greater values show better prevention of bleeding, and ratings of 3 or more show that the prevention of bleeding is at a practically usable level.

<light resistance of image>

One day after the printing with the typewriter, an image was exposed to sunlight for 5 hours, and the remaining state of the image was visually evaluated on the basis of five ratings. Greater values show higher light resistance, and ratings of 3 or more show that the light resistance is at a practically usable level.

<Durability of image against water>

One day after the printing with the typewriter, the bottom sheet was immersed in water for 1 hour, and the remaining state of an image was evaluated on the basis of five ratings. Greater values show higher durability, and ratings of 3 or more show that the durability is at a practically usable level.

<Stability of color former in solution>

A color former was dissolved in a solvent, and then the solution was allowed to stand at room temperature for 1 day. The stability of the color former in solution was visually evaluated on the basis of five ratings with regard to the presence or absence of a precipitated color former and the amount of the precipitated color former. Greater values show higher stability, and ratings of 3 or more show that the stability is at a practically usable level. Separately, 2 g of a color former was dissolved in 100 g of a solvent, and the solution was cooled to room temperature. In this case, a color former contained in the solution which turned opaque was rated at 3 or more, a color former which was soluble in an amount of 5 g or more was rated at 4 or more, and the precipitation state of a color former which was allowed to stand for 1 day was taken into consideration to determine the ratings of 3 to 5. Further, concerning a color former which was rated at 5, the solution containing the color former was allowed to stand at room temperature for 1 week, and then evaluated for stability of the color former in solution on the basis of 3 ratings. A stands for no precipitation, B stands for slight precipitation, and C stand for precipitation. The highest rating is 5A.

<Solvent odor>

The layer surface of an obtained top sheet which was coated with a layer containing microcapsules was rubbed against itself and smelt at for kinds and degrees of the solvent odor, and the solvent odor was evaluated on the basis of five ratings. Greater values show better prevention of an odor, and ratings of 3 or more show that the prevention of an odor is at a practically usable level.

TABLE 3

| Ex. or CEx. | Color form-ability | Abrasive scumming | Image bleeding | Light resist-ance of Image | Stability of color former in solution | Solvent odor |
|---|---|---|---|---|---|---|
| Ex.1 | 4 | 5 | 4 | 4 | 5C | 5 |
| Ex.2 | 4 | 5 | 4 | 4 | 3 | 5 |
| Ex.3 | 5 | 5 | 4 | 3 | 5B | 5 |
| CEx.1 | 4 | 4 | 4 | 1 | 2 | 5 |
| CEx.2 | 2 | 4 | 4 | 3 | 3 | 2 |
| CEx.3 | 2 | 4 | 4 | 3 | 3 | 2 |
| CEx.4 | 5 | 5 | 5 | 4 | 5A | 1 |

Ex. = Example, CEx. = Comparative Example

The color formers in Examples 1, 3 and 14 to 19 and Comparative Examples 1 and 7 were evaluated for stability in solution. Table 4 shows the results. Further, the obtained top sheets and commercially available carbonless pressure-sensitive copying paper bottom sheets (Mitsubishi NCR paper super N40bottom, supplied by Mitsubishi Paper Mills, Ltd.) using a salicylic acid derivative zinc salt as a color developer were combined, and printing was conducted with a typewriter. Each printed image was evaluated for color formability and hue of formed color. Table 4 shows the results.

TABLE 4

| Ex. or CEx. | Stability of color former in solution | Color formability | Hue of formed color |
|---|---|---|---|
| Ex. 1 | 5C | 4 | Excellent |
| Ex. 3 | 5B | 5 | Excellent |
| Ex. 14 | 5B | 4 | Excellent |
| Ex. 15 | 5C | 5 | Excellent |
| Ex. 16 | 4 | 5 | Excellent |
| Ex. 17 | 5A | 5 | Excellent |
| Ex. 18 | 5A | 5 | Excellent |
| Ex. 19 | 5B | 3 | Slightly blackish |
| CEx. 1 | 2 | 4 | Excellent |
| CEx. 7 | 4 | 3 | Black |

Ex. = Example, CEx. = Comparative Example

The top sheets obtained in Examples 1 and 3 and bottom sheets using a different color developer were combined and evaluated. As bottom sheets, commercially available carbonless pressure-sensitive copying paper bottom sheets (supplied by Arjo Wiggins Appleton) using an inorganic color developer formed from clay minerals as a raw material and paper bottom sheets (Mitsubishi NCR paper HP-N40 bottom, supplied by Mitsubishi Paper Mills, Ltd.) using a semi-synthetic solid acid as a color developer were used. A bottom sheet and a top sheet were combined, and printing was conducted with a typewriter, and tests were carried out with regard to color formability, abrasive scumming, image bleeding, light Table 5 shows the results, in which the results from the use Table 5 shows the results, in which the results from the use in Example 1 shown in Table 3.

TABLE 5

| Ex. | Color developer used in bottom sheet | Color form-ability | Image bleeding | Light resist-ance of image | Durability of image against water |
|---|---|---|---|---|---|
| Ex.1 | Salicylic acid-based color developer | 4 | 4 | 4 | 5 |
| Ex.1 | Clay minerals-based color developer | 3 | 5 | 4 | 3 |
| Ex.1 | Semi-synthetic solid acid | 4 | 5 | 5 | 5 |
| Ex.3 | Salicylic acid-based color developer | 5 | 4 | 3 | 5 |
| Ex.3 | Clay minerals-based color developer | 3 | 5 | 4 | 3 |
| Ex.3 | Semi-synthetic solid acid | 4 | 5 | 5 | 5 |

Ex. = Example

The top sheets obtained in Examples and Comparative 5 The top sheets obtained in Examples and Comparative Examples and commercially available carbonless pressure-super N40 bottom, supplied by Mitsubishi Paper Mills, Ltd.) super N40 bottom, supplied by Mitsubishi Paper Mills, Ltd.) developer were combined, and printing was conducted with a typewriter. Each printed image was evaluated for color formability, abrasive scumming, image bleeding and resistance of an image to light. Table 6 shows the results. Further, tests were also carried out with regard to the stability of color formers in solution and a solvent odor at the time of preparing microcapsules, and Table 6 also shows the results.

TABLE 6

| Ex. or CEx. | Color form-ability | Abrasive scumming | Image bleeding | Light resist-ance of image | Stability of color former in solution | Solvent odor |
|---|---|---|---|---|---|---|
| Ex.1 | 4 | 5 | 4 | 4 | 5C | 5 |
| Ex.3 | 5 | 5 | 4 | 3 | 5B | 5 |
| Ex.4 | 4 | 5 | 5 | 5 | 3 | 5 |
| Ex.5 | 4 | 4 | 4 | 5 | 3 | 5 |
| Ex.6 | 5 | 5 | 5 | 5 | 4 | 5 |
| Ex.7 | 5 | 4 | 5 | 5 | 4 | 4 |
| Ex.8 | 5 | 4 | 5 | 5 | 4 | 4 |
| Ex.9 | 5 | 5 | 4 | 3 | 4 | 5 |
| Ex.10 | 5 | 5 | 4 | 5 | 3 | 5 |
| Ex.11 | 5 | 3 | 5 | 5 | 4 | 3 |
| Ex.12 | 5 | 5 | 4 | 4 | 4 | 5 |
| Ex.13 | 5 | 5 | 4 | 3 | 4 | 5 |
| CEx.1 | 4 | 4 | 4 | 1 | 2 | 5 |
| CEx.5 | 3 | 2 | 4 | 5 | 2 | 5 |
| CEx.6 | 5 | 2 | 5 | 3 | 1 | 5 |

Ex. = Example, CEx. = Comparative Example

Table 3 shows the following. When MCT is used, the color former shows excellent stability in solution over, and it generates less odor than, the color former which is used in combination with a mixture of fatty acid triglycerides oil. Further, when the indolylazaphthalide compound is used oil. Further, when the indolylazaphthalide compound is used as a color former, the color former shows excellent stability in solution over CVL, and gives an image having excellent light Table 4 shows the following. When a mixture containing the indolylazaphthalide compound and other color former is used as a color former, the color former is improved in stability in solution. However, when a flouran-containing color former is used in a large amount, the formed blue color turns blackish, and the mixing ratio of the other color former is therefore limited.

Table 5 shows the following. When an inorganic color developer such as a clay minerals-containing color developer or a semi-synthetic solid acid is used, the degree of image bleeding is small as compared with the use of a salicylic acid-based color developer. In particular, when the semi-synthetic solid acid is used, an image is excellent in durability against water and light resistance as compared Table 6 shows the following. When MCT and the specified fatty acid ester solvent are used in combination, the stability of a color former in solution is not impaired, and the color formability, the prevention of image bleeding and the resistance of an image to light are excellent over the use of MCT alone.

EXAMPLES 20–39 and Comparative Examples 8–13

<Method of preparing microcapsules enclosing color former for
forming black color>

180 Parts of a hydrophobic color former solution prepared by dissolving 10 parts of a color former in 90 parts of a solvent was gradually added to 220 parts of a 5% styrene-maleic anhydride copolymer aqueous solution with stirring, and the mixture was continuously stirred until a COULTER counter (JAPAN SCIENTIFIC INSTRUMENTS COMPANY, Ltd.) showed a 50% volume average diameter of 6 $\mu$m, to give an emulsion. Separately, a melamine-formaldehyde initial condensate aqueous solution obtained by dissolving 11 parts of melamine, 21 parts of a 37% formaldehyde aqueous solution and 28 parts of water under heat was added to the emulsion, and the mixture was stirred at a temperature of 70° C. for 2 hours, to give a solution containing microcapsules containing the color former.

Those dyes and solvents which were used for microcapsules enclosing the color former in Examples and Comparative Examples and expressed by abbreviations were as follows. As color formers, a color former E: 3-diethylamino-7-(m-trifluoromethylanilino)fluoran, a color former F: 3-N-ethyl-N-isoamylamino-6-methyl-7-anilinofluoran, and a color former G: 3,3-bis(p-dimethylaminophenyl)-6-dimethylaminophthalide were used. As MCT, a triglyceride obtained from caprylic acid and capric acid (Panasate 810, supplied by Nippon Oil & Fats Co., Ltd.) was used.

<Methods of preparing color former coating liquid and top sheet>

50 Parts of wheat starch and 30 parts of a styrene-butadiene copolymer latex (supplied by Japan Synthetic Rubbers Co., Ltd.) were added to 100 parts of the liquid containing microcapsules enclosing the color former, to prepare a color former coating liquid. The coating liquid was applied to woodfree paper having a basis weight of 50 g/m$^2$ such that the application amount was 5 g/m$^2$, to give a top sheet for carbonless pressure-sensitive copying paper.

Microcapsules enclosing a color former in Examples and comparative examples were prepared from combinations of the color former(s) and solvent(s) shown in Tables 7 and 8, and top sheets in Examples 20 to 39 and Comparative Examples 8 to 13 were obtained.

TABLE 7

| | Color former | | Solvent | |
|---|---|---|---|---|
| Ex. or CEx. | Kind | Mixing ratio | Kind | Mixing ratio |
| Ex.20 | E | 100 | MCT | 100 |
| Ex.21 | E/F | 70/30 | MCT | 100 |
| Ex.22 | E/F | 50/50 | MCT | 100 |
| Ex.23 | E | 100 | MCT/isopropyl myristate | 10/90 |
| Ex.24 | E | 100 | MCT/n-butyl laurate | 20/80 |
| Ex.25 | E/F | 70/30 | MCT/isopropyl myristate | 50/50 |
| Ex.26 | E/F | 70/30 | MCT/ethyl laurate | 80/20 |
| Ex.27 | E/F | 70/30 | MCT/methyl myristate | 50/50 |
| Ex.28 | E/F | 50/50 | MCT/isobutyl palmitate | 90/10 |
| Ex.29 | E/F | 70/30 | MCT/methyl stearate | 50/50 |
| Ex.30 | E/F | 70/30 | MCT/isopropyl caprate | 50/50 |
| Ex.31 | E/F | 70/30 | MCT/isoamyl myristate | 50/50 |
| Ex.32 | E/F | 70/30 | MCT/2-ethylhexyl myristate | 50/50 |
| Ex.33 | E/F | 90/10 | MCT | 100 |
| Ex.34 | E/F | 40/60 | MCT | 100 |
| Ex.35 | E/F/G | 80/10/10 | MCT | 100 |
| Ex.36 | E/F/G | 60/20/20 | MCT | 100 |
| Ex.37 | E/F/G | 30/30/40 | MCT | 100 |
| Ex.38 | E/F/G | 70/0/30 | MCT | 100 |
| Ex.39 | E/F/G | 50/0/50 | MCT | 100 |

Ex. = Example, CEx. = Comparative Example

TABLE 8

| | Color former | | Solvent | |
|---|---|---|---|---|
| Ex. or CEx. | Kind | Mixing ratio | Kind | Mixing ratio |
| CEx.8 | F | 100 | MCT | 100 |
| CEx.9 | E | 100 | Coconut oil | 100 |
| CEx.10 | E | 100 | soybean oil | 100 |
| CEx.11 | E | 100 | Phenylxylylethane | 100 |
| CEx.12 | E | 100 | Isopropyl myristate | 100 |
| CEx.13 | F | 100 | Isopropyl myristate | 100 |

Ex. = Example, CEx. = Comparative Example

Top sheets obtained in Examples 20 to 22 and Comparative Examples 8 to 11 and commercially available carbonless pressure-sensitive copying paper bottom sheets (Mitsubishi NCR paper super N40 bottom, supplied by Mitsubishi Paper Mills, Ltd.) using a salicylic acid derivative zinc salt as a color developer were combined, and printing was conducted with a typewriter. Tests were conducted with regard to color formability, abrasive scumming, image bleeding and image light resistance according to the above evaluation methods or an evaluation method below. Table9shows the results. Further, tests were also carried out with regard to stability of the color formers in solution and the odor of the solvents when the microcapsules were produced, and Table 9 also shows the results.

<Resistance of image to discoloration under light>

One day after the printing with the typewriter, an image was exposed to sunlight for 2 hours, and the discoloration state of the image was visually evaluated on the basis of five ratings. Greater values show higher light resistance, and ratings of 3 or more show that the light resistance is at a practically usable level.

TABLE 9

| Ex. or CEx. | Color form-ability | Light resist-ance of image | Resistance of image to dis-coloration under light | Stability of color former in solution | Odor of solvent |
|---|---|---|---|---|---|
| Ex.20 | 4 | 4 | 5 | 4 | 5 |
| Ex.21 | 4 | 4 | 4 | 5C | 5 |
| Ex.22 | 5 | 4 | 3 | 5A | 5 |
| CEx.8 | 5 | 3 | 1 | 3 | 5 |
| CEx.9 | 2 | 3 | 4 | 2 | 2 |
| CEx.10 | 2 | 3 | 4 | 2 | 2 |
| CEx.11 | 5 | 5 | 5 | 5A | 1 |

Ex. = Example, CEx. = Comparative Example

The color formers in Examples 20 to 22 and 33 to 39 and Comparative Example 8 were evaluated for stability in solution. Table 10 shows the results. Further, the obtained top sheets and commercially available carbonless pressure-sensitive copying paper bottom sheets (Mitsubishi NCR paper super N40bottom, supplied by Mitsubishi Paper Mills, Ltd.) using a salicylic acid derivative zinc salt as a color developer were combined, and printing was conducted with a typewriter. Each printed image was evaluated for color formability and hue of formed color. Table 10 shows the results.

TABLE 10

| Ex. or CEx. | Stability of color former in solution | Color form-ability | Resistance of image to dis-coloration under light | Hue of formed color |
|---|---|---|---|---|
| Ex. 20 | 4 | 4 | 5 | Excellent |
| Ex. 21 | 5C | 4 | 4 | Excellent |
| Ex. 22 | 5A | 5 | 3 | Excellent |
| Ex. 33 | 4 | 4 | 5 | Excellent |
| Ex. 34 | 5A | 5 | 3 | Excellent |
| Ex. 35 | 5B | 5 | 5 | Excellent |
| Ex. 36 | 5A | 5 | 5 | Excellent |
| Ex. 37 | 5B | 5 | 5 | Slightly bluish |
| Ex. 38 | 4 | 5 | 5 | Excellent |
| Ex. 39 | 3 | 5 | 4 | Bluish |
| CEx. 8 | 4 | 5 | 1 | Excellent |

Ex. = Example, CEx. = Comparative Example

The top sheets obtained in Examples 20 and 22 and bottom sheets using a different color developer were combined and evaluated. As bottom sheets, commercially available carbonless pressure-sensitive copying paper bottom sheets (supplied by Ajo Wiggins Appleton) using an inorganic color developer formed from clay minerals as a raw material and paper bottom sheets (Mitsubishi NCR paper HP-N40 bottom, supplied by Mitsubishi Paper Mills, Ltd.) using a semi-synthetic solid acid as a color developer were used. A bottom sheet and a top sheet were combined, and printing was conducted with a typewriter, and tests were carried out with regard to color formability, abrasive scumming, image bleeding, light resistance of an image and durability of an image against water. Table 5 shows the results.

TABLE 11

| Ex. | Color developer used in bottom sheet | Color form-ability | Image bleeding | Light resist-ance of image | Durability of image against water |
|---|---|---|---|---|---|
| Ex.20 | Salicylic acid-based color developer | 4 | 3 | 4 | 5 |
| Ex.20 | Clay minerals-based color developer | 3 | 5 | 4 | 3 |
| Ex.20 | Semi-synthetic solid acid | 4 | 5 | 5 | 5 |
| Ex.22 | Salicylic acid-based color developer | 5 | 3 | 4 | 5 |
| Ex.22 | Clay minerals-based color developer | 3 | 5 | 4 | 3 |
| Ex.22 | Semi-synthetic solid acid | 4 | 5 | 5 | 5 |

Ex. = Example

The top sheets obtained in Examples and Comparative Examples and commercially available carbonless pressure-sensitive copying paper bottom sheets (Mitsubishi NCR paper super N40 bottom, supplied by Mitsubishi Paper Mills, Ltd.) using a salicylic acid derivative zinc salt as a color developer were combined, and printing was conducted with a typewriter. Each printed image was evaluated for color formability, abrasive scumming, image was bleeding and resistance of an image to light. Table 12 shows the results. Further, tests were also carried out with regard to the stability of color formers in solution at the time of preparing microcapsules, and Table 12 also shows the results.

TABLE 12

| Ex. or CEx. | Color form-ability | Abrasive scumming | Image bleed-ing | Light resist-ance of image | Resistance of image to dis-coloration under light | Stability of color former in solution |
|---|---|---|---|---|---|---|
| Ex.20 | 4 | 5 | 3 | 4 | 5 | 4 |
| Ex.21 | 4 | 5 | 3 | 4 | 4 | 5C |
| Ex.22 | 5 | 5 | 3 | 4 | 3 | 5A |
| Ex.23 | 4 | 3 | 5 | 5 | 5 | 3 |
| Ex.24 | 4 | 3 | 4 | 5 | 5 | 3 |
| Ex.25 | 5 | 4 | 4 | 5 | 4 | 4 |
| Ex.26 | 5 | 5 | 3 | 4 | 4 | 5C |
| Ex.27 | 5 | 4 | 4 | 4 | 4 | 4 |
| Ex.28 | 5 | 5 | 3 | 4 | 3 | 5A |
| Ex.29 | 4 | 3 | 4 | 4 | 4 | 3 |
| Ex.30 | 5 | 3 | 4 | 4 | 4 | 4 |
| Ex.31 | 5 | 4 | 3 | 4 | 4 | 3 |
| Ex.32 | 4 | 4 | 3 | 4 | 4 | 3 |
| CEx.8 | 5 | 4 | 3 | 3 | 1 | 3 |

TABLE 12-continued

| Ex. or CEx. | Color formability | Abrasive scumming | Image bleeding | Light resistance of image | Resistance of image to discoloration under light | Stability of color former in solution |
|---|---|---|---|---|---|---|
| CEx.12 | 4 | 2 | 5 | 5 | 1 | 1 |
| CEx.13 | 4 | 2 | 5 | 3 | 5 | 1 |

Ex. = Example, CEx. = Comparative Example

Table 9 shows the following. When MCT is used, the color former shows excellent color formability and excellent stability in solution over, and it generates less odor than, the color former which is used in combination with a mixture of fatty acid triglycerides having a high molecular weight such as coconut oil or soybean oil. Further, when the fluoran compound having a trifluoromethylanilino group is used as a color former, the color former shows excellent stability in solution over any other fluoran compound, and gives an image having excellent light resistance and excellent resistance to discoloration under light over an image obtained by using any other fluoran compound.

Table 10 shows the following. When a mixture containing the fluoran compound having a trifluoromethylanilino group and other color former is used as a color former, the color former is improved in stability in solution. However, the mixing ratio of CVL is limited in view of the hue of a formed color.

Table 11 shows the following. When an inorganic color developer such as a clay minerals-containing color developer or a semi-synthetic solid acid is used, the degree of image bleeding is small as compared with the use of a salicylic acid-based color developer. In particular, when the semi-synthetic solid acid is used, an image is excellent in durability against water and light resistance as compared with a clay minerals-containing color developer.

Table 12 shows the following. When MCT and the specified fatty acid ester solvent are used in combination, the stability of a color former in solution is not impaired, and the color formability, the prevention of image bleeding and the resistance of an image to light are excellent over the use of MCT alone.

Each of the top sheets obtained in Examples 1 and 20 and Comparative Examples 4 and 11 was set in an electrophotographic non-impact printer using a heat-fixing toner (IBM-3800, supplied by IBM), and printing was conducted on the surface to which the coating liquid containing the microcapsules had not bee applied. The printing was carried out for about 10 minutes each, and just after the printing was finished, the top sheets were evaluated for an odor and the exhaust portion of the printer was evaluated for an odor. As a result, the top sheets obtained in Examples 1 and 20 gave almost no odor, while it was found that the top sheets obtained in Comparative Examples 4 and 11 generated a considerably intense odor.

When a middle-length-chain triglyceride (MCT) is used as a solvent to be enclosed in microcapsules, and when an indolylazaphthalide compound or a fluoran compound having a trifluoromethylanilino group is used as a color former, for producing a carbonless pressure-sensitive copying paper coated with a layer containing microcapsules enclosing a color former, there can be provided a carbonless pressure-sensitive copying paper which is excellent in color formability and the property of keeping an image, and which is free of an unpleasant odor and friendly to environments. Further, when a color former different in kind is used in combination with each of the above color formers, the stability of the color formers in solution is increased. Moreover, when MCT and the specified fatty acid ester solvent are used in combination as a solvent, or when an inorganic color developer, preferably a semi-synthetic solid acid, is used as a color developer, there can be obtained a carbonless pressure-sensitive copying paper which is more excellent in the property of keeping an image and the preventing of image bleeding.

What is claimed is:

1. A carbonless pressure-sensitive copying paper for forming a color-formed image on the basis of a color-forming reaction between an electron-donating color former and an electron-accepting color developer, the carbonless pressure-sensitive copying paper comprising a substrate sheet coated with a layer containing microcapsules each of which encloses a solution containing electron-donating color former dissolved in a middle-length-chain triglyceride as a solvent.

2. The carbonless pressure-sensitive copying paper of claim 1, wherein the middle-length-chain triglyceride has a viscosity of 10 to 40 centipoise at 25° C.

3. The carbonless pressure-sensitive copying paper of claim 1, wherein the middle-length-chain triglyceride contains no unsaturated bond and has a liquid state at 25° C.

4. The carbonless pressure-sensitive copying paper of claim 1, wherein the middle-length-chain triglyceride is a middle-length-chain triglyceride formed from a saturated fatty acid having 6 to 10 carbon atoms and glycerin.

5. The carbonless pressure-sensitive copying paper of claim 1, wherein the solvent contains a fatty acid ester solvent in combination with the middle-length-chain triglyceride.

6. The carbonless pressure-sensitive copying paper of claim 5, wherein the fatty acid ester solvent is a fatty acid ester which has 14 to 20 carbon atoms and is synthesized from a lower alcohol having 1 to 4 carbon atoms and a fatty acid having 12 to 16 carbon atoms.

7. The carbonless pressure-sensitive copying paper of claim 5, wherein the solvent contains 20 to 90% by weight of the middle-length-chain triglyceride and 10 to 80% by weight of the fatty acid ester solvent.

8. The carbonless pressure-sensitive copying paper of claim 1, wherein the electron-donating color former is a color former which is soluble in the middle-length-chain triglyceride in an amount of 1 to 20 g per 100 g of the middle-length-chain triglyceride.

9. The carbonless pressure-sensitive copying paper of claim 1, wherein the electron-donating color former is an indolylazaphthalide compound of the formula (1),

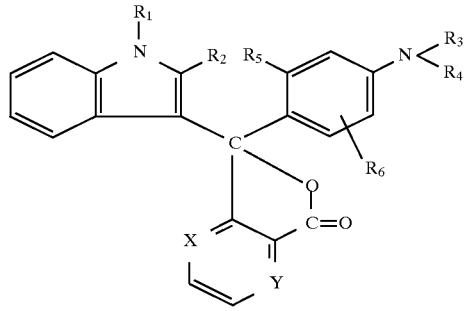

(1)

wherein $R_1$ is a substituted or non-substituted alkyl group having 1 to 12 carbon atoms, $R_2$ is a hydrogen atom or an alkyl group having 1 to 8 carbon atoms, each of $R_3$ and $R_4$ is independently a hydrogen atom, a substituted or non-substituted alkyl group having 1 to 12 carbon atoms, a cycloalkyl group, a benzyl group or a phenyl group, each of $R_5$ and $R_6$ is a hydrogen atom, a halogen atom, an alkyl group having 1 to 8 carbon atoms or an alkoxy group having 1 to 12 carbon atoms, one of X and Y is —N═ and the other of X and Y is —CH═.

10. The carbonless pressure-sensitive copying paper of claim 9, wherein the electron-donating color former contains the indolylazaphthalide compound of the formula (1) as a main component and further contains Crystal Violet Lactone.

11. The carbonless pressure-sensitive copying paper of claim 10, wherein the electron-donating color former is composed of 40 to 90% by weight of the indolylazaphthalide compound of the formula (1), 10 to 40% by weight of the Crystal Violet Lactone and 0 to 20% by weight of the fluoran compound of the formula (2).

12. The carbonless pressure-sensitive copying paper of claim 9, wherein the electron-donating color former contains the indolylazaphthalide compound of the formula (1) as a main component and further contains Crystal Violet Lactone and a fluoran compound of the formula (2),

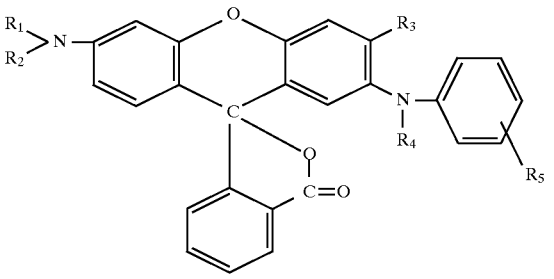

(2)

wherein each of $R_1$ and $R_2$ is independently a lower alkyl group, $R_3$ is a hydrogen atom, a lower alkyl group or a halogen atom, $R_4$ is a hydrogen atom or a lower alkyl group, and $R_5$ is a hydrogen atom or an optionally substituted lower alkyl group.

13. The carbonless pressure-sensitive copying paper of claim 1, wherein the electron-donating color former is a fluoran compound of the formula (3),

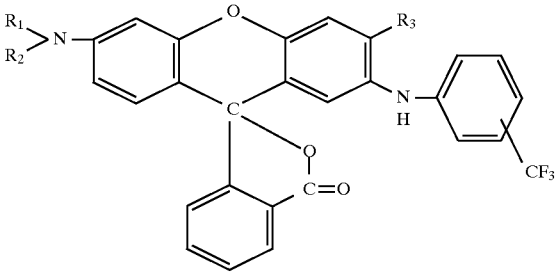

(3)

wherein each of $R_1$ and $R_2$ is independently a lower alkyl group or a cycloalkyl group and $R_3$ is hydrogen or a lower alkyl group.

14. The carbonless pressure-sensitive copying paper of claim 13, wherein the electron-donating color former contains the fluoran compound of the formula (3) as a main component and further contains a fluoran compound of the formula (4),

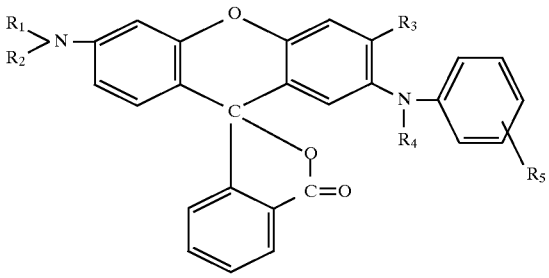

(4)

wherein each of $R_1$ and $R_2$ is independently a lower alkyl group, $R_3$ is a hydrogen atom, a lower alkyl group or a halogen atom, $R_4$ is a hydrogen atom or a lower alkyl group, and $R_5$ is a hydrogen atom or a lower alkyl group.

15. The carbonless pressure-sensitive copying paper of claim 14, wherein the electron-donating color former contains the fluoran compound of the formula (3) as a main component and further contains the fluoran compound of the formula (4) and Crystal Violet Lactone.

16. The carbonless pressure-sensitive copying paper of claim 14, wherein the electron-donating color former is composed of the fluoran compound of the formula (3), the fluoran compound of the formula (4) and Crystal Violet Lactone, and the electron-donating color former contains 30 to 80% by weight of the fluoran compound of the formula (3), 10 to 50% by weight of the fluoran compound of the formula (4) and 0 to 40% by weight of the Crystal Violet Lactone, the total amount of the fluoran compound of the formula (3) and the fluoran compound of the formula (4) being 60 to 100% by weight based on the total amount of the color former.

17. The carbonless pressure-sensitive copying paper of claim 1, wherein the carbonless pressure-sensitive copying paper comprises a color former sheet obtained by coating the substrate sheet with the layer containing microcapsules enclosing the electron-donating color former dissolved in the solvent and a color developer sheet obtained by coating other substrate sheet with a layer containing an inorganic color developer formed of clay minerals as an electron-accepting color developer.

18. The carbonless pressure-sensitive copying paper of claim 1, wherein the carbonless pressure-sensitive copying paper has a layer containing microcapsules enclosing the electron-donating color former dissolved in the solvent and a layer containing the electron-accepting color developer on one surface or different surfaces of the substrate sheet, the color developer being an inorganic color developer formed from clay minerals.

19. The carbonless pressure-sensitive copying paper of claim 1, wherein the color developer is a semi-synthetic solid acid obtained by treating clay minerals with an acid, then mixing and neutralizing the acid-treated clay mineral with at least one of an aluminum compound and a magnesium compound in an aqueous medium to introduce at least one component of magnesium and aluminum into the acid-treated clay minerals and drying the acid-treated clay minerals.

20. The carbonless pressure-sensitive copying paper of claim 1, which is used for non-impact printer in which printing is conducted with an electrophotographic non-impact printer using a heat-fixing toner in advance.

* * * * *